US005769330A

United States Patent [19]

Rogowski

[11] Patent Number: 5,769,330

[45] Date of Patent: Jun. 23, 1998

[54] SPOUTED BED WOOD CHIP DEBARKER/ CLEANER

[75] Inventor: Donald Frank Rogowski, Covington, Va.

[73] Assignee: Westvaco Corporation, New York, N.Y.

[21] Appl. No.: 633,199

[22] Filed: Apr. 16, 1996

[51] Int. Cl.[6] ..... B02C 19/06; B02C 19/12

[52] U.S. Cl. ..... 241/5; 241/18; 241/24.29; 241/40; 241/51; 241/79.1

[58] Field of Search ..... 241/5, 18, 24.29, 241/28, 40, 49, 51, 79.1, 39

[56] References Cited

U.S. PATENT DOCUMENTS

| | | | |
|---|---|---|---|
| Re. 33,840 | 3/1992 | Peterson et al. . | |
| 1,211,736 | 1/1917 | Marshall | 241/39 |
| 1,420,362 | 6/1922 | Billingham | 241/40 |
| 1,700,390 | 1/1929 | Ullgren . | |
| 2,119,887 | 6/1938 | Myers | 241/40 |
| 2,813,318 | 11/1957 | Horth | 241/40 X |
| 3,305,414 | 2/1967 | Hodgson | 241/40 X |
| 3,746,063 | 7/1973 | Smiltneek . | |
| 4,043,901 | 8/1977 | Gauld . | |
| 4,140,281 | 2/1979 | Fulghum, Jr. et al. . | |
| 5,044,412 | 9/1991 | Price et al. . | |
| 5,097,880 | 3/1992 | Pousette . | |

FOREIGN PATENT DOCUMENTS

| | | |
|---|---|---|
| 1179697 | 10/1964 | Germany . |
| 68393 | 11/1929 | Sweden . |

*Primary Examiner*—John M. Husar
*Attorney, Agent, or Firm*—J. R. McDaniel; R. L. Schmalz

[57] ABSTRACT

This invention relates to a spouted bed wood chip debarker/ cleaner. Such structures of this type, generally, cause wood chips and bark to undergo attrition by accelerating the wood chips and bark with a jet of air. In particular, the accelerated wood chips and bark are impinged on a screen. When the wood chips hit the screen, bark and wood chips experience attrition. Small pieces of bark and other debris (sand, for example) will be exhausted through the screen which is too fine of a mesh to let desirable size wood chips be exhausted.

6 Claims, 1 Drawing Sheet

SPOUTED BED WOOD CHIP DEBARKER/ CLEANER

BACKGROUND OF THE INVENTION

1. Field of the Invention:

This invention relates to a spouted bed wood chip debarker/ cleaner. Such structures of this type, generally, cause wood chips and bark to undergo attrition by accelerating the wood chips and bark with a jet of air. In particular, the accelerated wood chips and bark are impinged on a screen. When the wood chips hit the screen, bark and wood chips experience attrition. Small pieces of bark and other debris (sand, for example) will be exhausted through the screen which is too fine of a mesh to let desirable size wood chips be exhausted.

2. Description of the Related Art:

It is known, in prior debarking systems, to remove bark from wood chips by mechanically agitating the wood chips in a drum. This agitation has been done with and without items other than wood chips, i.e., metal balls, metal blocks, logs, etc. These approaches have generally removed attached bark from the wood chips, but the loosened bark was then ground back into the wood chips, which is undesirable.

It is also known, in debarking systems, to employ the use of a stream of gas. Exemplary of such prior art is U.S. Pat. No. 4,140,281('281) to O. T. Fulghum et al., entitled "Separation of Dirt and Bark from Wood Chips". The '281 reference entails the mixing of wood chips in a stream of gas, impinging the resulting stream of dispersed solids onto an impact surface to dislodge particles of dirt and bark from the wood chips, and thereafter, subjecting the solids to a classifying operation which separates the finer particles of dirt and bark from the coarser wood chips. However, a more advantageous debarker/cleaner would be presented if such amounts of dirt and bark could be more easily removed.

It is apparent from the above that there exists a need in the art for a system which is capable of debarking/cleaning wood chips, and which at least equals the debarking/ cleaning characteristics of the known debarkers/cleaners, but which at the same time is able to more easily debark/ clean the wood chips. It is the purpose of this invention to fulfill this and other needs in the art in a manner more apparent to the skilled artisan once given the following disclosure.

SUMMARY OF THE INVENTION

Generally speaking, this invention fulfills these needs by providing a spouted bed wood chip debarker/cleaner, comprising a spouted bed means having a first and second end, an air inlet means operatively connected to the first end of the bed means, a wood chip inlet means operatively connected to the bed means, a wood chip outlet means operatively connected to the bed means and located a predetermined distance away from the wood chip inlet means, a tube means having a first and second end located substantially within the bed means such that the first end of the tube is located substantially adjacent to the first end of the bed means and the second end of the tube means is located substantially adjacent to the second end of the bed means, and a screen means operatively connected to the second end of the bed means.

In certain preferred embodiments, the wood chip inlet and outlet means are located substantially above the air inlet means. Also, the tube means is a draft tube.

In another further preferred embodiment, the wood chips are more easily debarked/cleaned due to the acceleration of the wood chips with the jet of air. As the accelerated wood chips are impinged on the screen, wood chips and bark undergo attrition and debris is removed from the wood chips. The debris is exhausted through the screen while the desirable wood chips are retained and transported back into the debarker/cleaner. Some of the desirable wood chips are transported out of the debarker/cleaner.

The preferred wood chip debarker/cleaner, according to this invention, offers the following advantages: ease of assembly and repair; good stability; good durability; excellent economy; and excellent cleaning/debarking characteristics. In fact, in many of the preferred embodiments, these factors of economy and cleaning/debarking are optimized to an extent that is considerably higher than heretofore achieved in prior, known wood chip cleaners/debarkers.

BRIEF DESCRIPTION OF THE DRAWING

The above and other features of the present invention, which will become more apparent as the description proceeds, are best understood by considering the following detailed description in conjunction with the accompanying drawing, in which the single FIGURE is a schematic illustration of a spouted bed wood chip debarker/cleaner, according to the present invention.

DETAILED DESCRIPTION OF THE INVENTION

Figure 1:
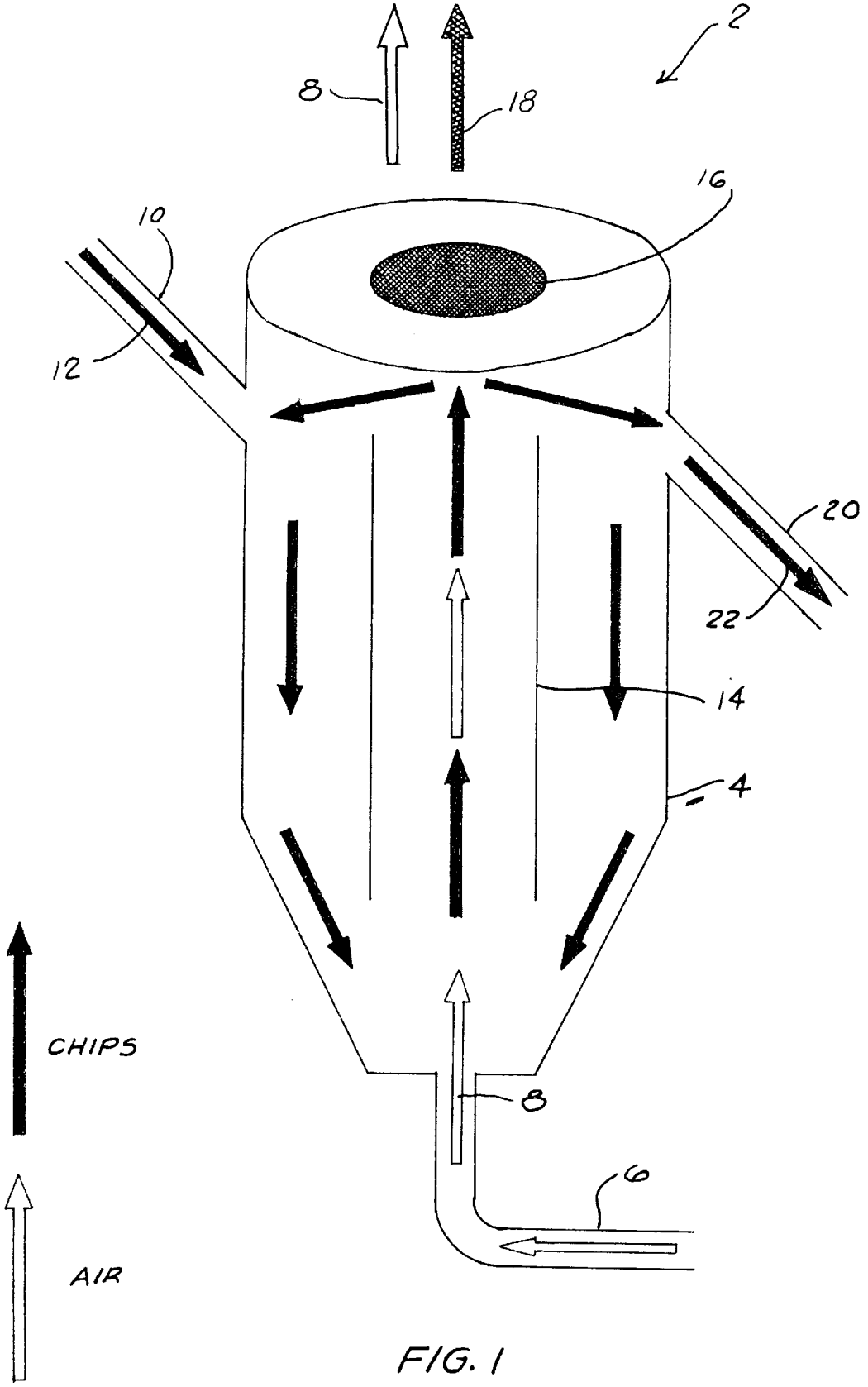

With reference to the FIGURE, there is illustrated an advantageous environment for the use of the concepts of this invention. As shown in the FIGURE, wood chip debarker/ cleaner 2 includes, in part, bed 4, air inlet 6, air stream 8, wood chip inlet 10, uncleaned wood chip stream 12, draft tube 14, screen 16, bark and other debris 18, wood chip outlet 20, and debarked/cleaned wood chip stream 22.

With respect to bed 4, air inlet 6, wood chip inlet 10, draft tube 14, and wood chip outlet 20, these, preferably, are constructed of any suitable high strength material, such as metal. The mesh size of screen 16, preferably, is such that desirable size wood chips will not be exhausted through screen 16. A screen size hole of approximately three-sixteenths of an inch or less would be sufficient to accomplish the task.

During the operation of wood chip debarker/cleaner 2, whole tree wood chips 12 are fed into bed 4 through wood chip inlet 10. Wood chips 12 may also be introduced into bed 4 with jet of air through air inlet 6. Wood chips 12 drop down to the bottom of bed 4 in the annular ring outside of draft tube 14. Steep angled sides at the bottom of bed 4 form a funnel which feeds wood chips 12 to the center of bed 4. At the center and bottom of bed 4 is a jet of air 8 with sufficient velocity, volume and an appropriate diameter to entrain the wood chips 12 in the air flow. Preferably, the air velocity is such that the wood chips and bark experience attrition when they impact screen 16. Typical air velocities are approximately 500 to 3,000 feet/minute. The entrained wood chips 12 are carried up inside of a draft tube 14 and are accelerated. Wood chips 12 and air 8 exit the top of draft tube 14 and impinge on screen 16 at the top of the debarker/cleaner 2. When the wood chips 12 impinge upon screen 16, on wood chips 12 experience attrition. Air 8 exits bed 4 through screen 16 along with debris 18 sufficient to fit through the screen 16, i.e., bark, dirt, sand, pins, fines, and leaf matter. Wood chips 12 impinging on screen 16 either bounce off of screen 16 or are pushed off of screen 16 by other wood chips 12 or the air flow. Wood chips 12 then move back to the bottom of bed 4 to repeat the process. Bark and/or debris may also be removed from wood chips 12 as wood chips 12 move to the bottom of bed 4. Debarked/cleaned wood chips 22 leave the debarker/cleaner 2 through outlet 20.

It is to be understood that the present invention can be used in either a batch mode or a continuous mode. The spouted bed wood chip debarker/cleaner 2 can be used in either a parallel arrangement or a series arrangement of debarkers/cleaners or both. There are a number of variables that can control wood chip attrition/chip cleaning. For example, the impingement velocity of the wood chips on the screen will influence debarking/cleaning. Also, the residence time of wood chips 12 in the debarker/cleaner 2 affect attrition cleaning. Finally, screen 16 mesh size will impact attrition/cleaning.

Once given the above disclosure, many other features, modifications or improvements will become apparent to the skilled artisan. Such features, modifications or improvements are, therefore, considered to be a part of this invention, the scope of which is to be determined by the following claims.

What is claimed is:

1. A spouted bed wood chip debarker/cleaner, which is comprised of:

a spouted bed means having a first and second end;

an air inlet means operatively connected to said first end of said bed means;

a wood chip inlet means operatively connected to said bed means, wherein said wood chip inlet means is located substantially above said air inlet means;

a wood chip outlet means operatively connected to said bed means and located a predetermined distance away from said wood chip inlet means, wherein said wood chip outlet means is located substantially above said air inlet means;

a tube means having a first and second end located substantially within said bed means such that said first end of said tube is located substantially adjacent to said first end of said bed means and said second end of said tube means is located substantially adjacent to said second end of said bed means; and a screen means operatively connected to said second end of said bed means.

2. The debarker/cleaner, as in claim 1, wherein said bed means is further comprised of:

an angled side located substantially adjacent to said first end of said bed.

3. The debarker/cleaner, as in claim 1, wherein said screen means is further comprised of:

a screen hole size of substantially three-sixteenths of an inch or less.

4. The debarker/cleaner, as in claim 1, wherein said tube means is further comprised of:

a draft tube.

5. A method of debarking/cleaning wood chips wherein said method is comprised of the steps of:

collecting wood chips to be debarked/cleaned into a first end of a bed means;

transporting air to said first end of said bed means;

impinging said air on said wood chips to be debarked/cleaned;

transporting said air and said chips to be debarked/cleaned through a tube means located substantially within said bed means to accelerate said air and chips to be debarked/cleaned;

impinging said air and chips to be debarked/cleaned upon a screen means operatively connected to a second end of said bed such that bark and other debris attached to said chips is expelled through said screen and debarked/cleaned chips are retained within said bed;

feeding said debarked/cleaned chips from said bed, wherein said step of feeding said debarked/cleaned chips from said bed is accomplished substantially adjacent to said second end of said bed; and feeding wood chips to be debarked/cleaned into said bed means at location adjacent to said second end of said bed means.

6. The method, as in claim 5, wherein said step of impinging air on said wood chips to be debarked/cleaned is further comprised of the step of:

impinging said air at a velocity of at least 500 feet/minute.

* * * * *